US010680349B2

(12) United States Patent
Kwon

(10) Patent No.: US 10,680,349 B2
(45) Date of Patent: Jun. 9, 2020

(54) ANTENNA DEVICE AND ELECTRONIC DEVICE INCLUDING THE SAME

(71) Applicant: Samsung Electronics Co., Ltd., Gyeonggi-do (KR)

(72) Inventor: Tae Wook Kwon, Gyeonggi-do (KR)

(73) Assignee: Samsung Electronics Co., Ltd. (KR)

( * ) Notice: Subject to any disclaimer, the term of this patent is extended or adjusted under 35 U.S.C. 154(b) by 69 days.

(21) Appl. No.: 14/319,982

(22) Filed: Jun. 30, 2014

(65) Prior Publication Data

US 2015/0214635 A1 Jul. 30, 2015

(30) Foreign Application Priority Data

Jan. 24, 2014 (KR) ..... 10-2014-0008671

(51) Int. Cl.

| | |
|---|---|
| ***H01Q 1/24*** | (2006.01) |
| ***H01Q 21/30*** | (2006.01) |
| ***H01Q 5/371*** | (2015.01) |
| *H01Q 1/38* | (2006.01) |

(52) U.S. Cl.

CPC ..... *H01Q 21/30* (2013.01); *H01Q 5/371* (2015.01); *H01Q 1/243* (2013.01); *H01Q 1/38* (2013.01)

(58) Field of Classification Search

CPC ..... H01Q 21/30; H01Q 5/371; H01Q 9/045; H01Q 21/0006; H01Q 1/243; H01Q 5/00; H01Q 9/42; H01Q 9/46; H01Q 1/241–244; H01Q 5/48; H01Q 5/357

USPC ..... 343/700 MS, 853, 702

See application file for complete search history.

(56) References Cited

U.S. PATENT DOCUMENTS

| | | | | |
|---|---|---|---|---|
| 6,600,455 | B2 * | 7/2003 | Yamamoto | H01Q 9/42 343/826 |
| 7,218,282 | B2 | 5/2007 | Humpfer et al. | |
| 7,405,701 | B2 | 7/2008 | Ozkar | |
| 2007/0069958 | A1 * | 3/2007 | Ozkar | H01Q 9/0421 343/700 MS |
| 2009/0051611 | A1 * | 2/2009 | Shamblin | H01Q 1/243 343/747 |
| 2009/0224991 | A1 * | 9/2009 | Rowson | H01Q 1/243 343/747 |

(Continued)

FOREIGN PATENT DOCUMENTS

| | | |
|---|---|---|
| JP | 2001016010 | 1/2001 |
| JP | 2002246815 | 8/2002 |

(Continued)

OTHER PUBLICATIONS

The ARRL Antenna Book, Published by the American Radio Relay League.*

(Continued)

*Primary Examiner* — Hoang V Nguyen
*Assistant Examiner* — Awat M Salih
(74) *Attorney, Agent, or Firm* — The Farrell Law Firm, P.C.

(57) ABSTRACT

An antenna device is provided. The device includes a first antenna unit having a plurality of resonant frequency bands, a second antenna unit configured to shift a resonant frequency of a part of the plurality of resonant frequency bands of the first antenna unit, and a feeding unit configured to connect the first and second antenna units and to supply current thereto.

6 Claims, 7 Drawing Sheets

(56) References Cited

U.S. PATENT DOCUMENTS

2010/0214174 A1* 8/2010 Guan ..... H01Q 1/243 343/700 MS
2010/0245177 A1* 9/2010 Jagielski ..... H01Q 1/243 343/702
2012/0306702 A1* 12/2012 Kaneko ..... H01Q 5/385 343/700 MS
2013/0016024 A1* 1/2013 Shi ..... H01Q 1/243 343/833
2013/0093630 A1* 4/2013 Hsu ..... H01Q 1/243 343/702
2013/0099006 A1* 4/2013 Hong ..... H01Q 1/2283 235/492
2013/0249765 A1* 9/2013 Su ..... H01Q 1/243 343/850
2013/0285857 A1* 10/2013 Schultz ..... H01Q 5/0027 343/700 MS
2014/0002309 A1* 1/2014 Huang ..... H01Q 9/30 343/700 MS
2014/0210486 A1* 7/2014 Dijkstra ..... H01Q 3/28 324/612
2015/0077292 A1* 3/2015 Kalistaja ..... H01Q 21/28 343/702

FOREIGN PATENT DOCUMENTS

| | | |
|---|---|---|
| JP | 2006-524940 | 11/2006 |
| JP | 2009-510900 | 3/2009 |
| JP | 2010-288175 | 12/2010 |
| JP | 2012-169805 | 9/2012 |
| JP | 2012-169896 | 9/2012 |
| KR | 200464997 | 1/2013 |
| KR | 1020130042909 | 4/2013 |
| WO | WO-2007060782 | 5/2007 |

OTHER PUBLICATIONS

The ARRL Antenna Book.*
Korean Office Action dated Aug. 19, 2019 issued in counterpart application No. 10-2014-0008671, 10 pages.
Korean Office Action dated Mar. 18, 2020 issued in counterpart application No. 10-2014-0008671, 4 pages.

* cited by examiner

ANTENNA DEVICE AND ELECTRONIC DEVICE INCLUDING THE SAME

PRIORITY

This application claims priority under 35 U.S.C. § 119(a) to Korean Patent Application Serial No. 10-2014-0008671, which was filed in the Korean Intellectual Property Office on Jan. 24, 2014, the entire disclosure of which is incorporated herein by reference.

BACKGROUND

1. Field of the Invention

The present invention generally relates to antenna devices and electronic devices including the same.

2. Description of the Related Art

Electronic devices for wireless communication have become important for everyday life. Electronic devices for wireless communication may be provided with antenna devices for performing wireless communication. Early antennas that protruded from electronic devices have been improved to built-in antennas in order to prevent damage to antennas and improve portability of electronic devices.

Furthermore, with the development of multifunctional electronic devices, built-in antennas are required to operate at various frequency bands.

As electronic devices become smaller, meander-structured antennas are being widely installed to satisfy specific resonant frequency bands in limited spaces. Such meander-structured antennas may have a small size, but may be degraded in performance.

In addition, various frequency bands are used for wireless communication in different nations/regions. If structures of antennas are modified to satisfy such various frequency bands, all resonant frequency bands may be affected by the modification.

SUMMARY

The present invention has been made to address at least the above-mentioned problems and/or disadvantages and to provide at least the advantages described below. Accordingly, an aspect of the present invention is to provide an antenna device for shifting a resonant frequency of a part of a plurality of resonant frequency bands and for improving antenna performance, and an electronic device including the same.

In accordance with an aspect of the present invention, an antenna device includes a first antenna unit having a plurality of resonant frequency bands, a second antenna unit that shifts a resonant frequency of a part of the plurality of resonant frequency bands of the first antenna unit, and a feeding unit that connects the first and second antenna units and supplies current thereto.

In accordance with another aspect of the present invention, an electronic device for transmitting/receiving signals, the electronic device includes a first antenna unit having a plurality of resonant frequency bands; a second antenna unit configured to shift a resonant frequency of a part of the plurality of resonant frequency bands of the first antenna unit; and a feeding unit configured to connect the first antenna unit and the second antenna unit and to supply current thereto.

In accordance with another aspect of the present invention, a method for shifting a resonant frequency of an antenna device, the method includes shifting, by a second antenna unit, a resonant frequency of a part of a plurality of resonant frequency bands of a first antenna unit, wherein the second antenna unit is formed on a plane parallel with the first antenna unit while being spaced apart from the second antenna unit.

BRIEF DESCRIPTION OF THE DRAWINGS

The above and other aspects, features and advantages of embodiments of the present invention will be more apparent from the following detailed description taken in conjunction with the accompanying drawings, in which.

Throughout the drawings, like reference numerals will be understood to refer to like parts, components, and structures.

DETAILED DESCRIPTION OF EMBODIMENTS OF THE PRESENT INVENTION

Hereinafter, embodiments of the present invention will be described in detail with reference to the accompanying drawings. In the description herein, well-known functions and structures which may unnecessarily obscure the subject matter of the present invention will not be described. It includes various specific details to assist in that understanding but these are to be regarded as mere examples. Accordingly, those of ordinary skill in the art will recognize that various changes and modifications of the various embodiments described herein can be made without departing from the scope and spirit of the present invention. In addition, descriptions of well-known functions and constructions may be omitted for clarity and conciseness.

Figure 1:
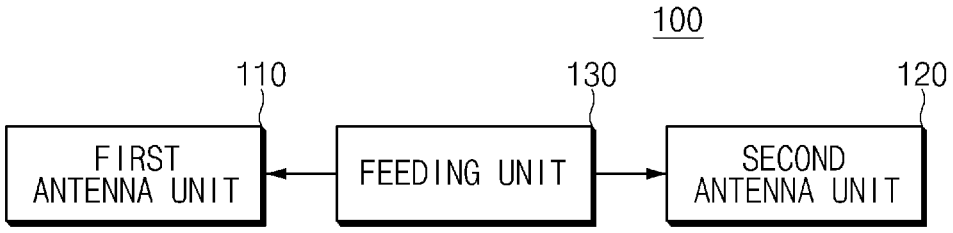
FIG. 1 is a block diagram illustrating a configuration of an antenna device according to an embodiment of the present invention.

FIG. 1 is a block diagram illustrating a configuration of an antenna device according to an embodiment of the present invention.

Referring to FIG. 1, an antenna device 100 includes, for example, a first antenna unit 110, a second antenna unit 120, and a feeding unit 130.

The first antenna unit 110 has a plurality of resonant frequency bands. The first antenna unit 110 includes at least one antenna pattern. Each antenna pattern includes a main antenna pattern and at least one sub antenna pattern according to shapes thereof. The number of resonant frequency bands and a frequency of each resonant frequency band are determined with respect to the first antenna unit 110 according to the number of antenna patterns and a direction, length or shape of each antenna pattern.

The first antenna 110 may be implemented with various types of antennas such as a monopole antenna, a dipole antenna and a Planar Inverted F-type Antenna (PIFA) antenna.

The second antenna unit 120 shifts a resonant frequency of a part of the plurality of resonant frequency bands of the first antenna unit 110. For example, the second antenna unit 120 shifts a resonant frequency of a part of the plurality of resonant frequency bands of the first antenna unit 110 without shifting resonant frequencies of the other resonant frequency bands.

The second antenna unit 120 is formed on a Printed Circuit Board (PCB). For example, the second antenna unit 120 is implemented with a microstrip line formed on the PCB. The second antenna unit 120 may be implemented with a microstrip line separate from microstrip lines that connect electronic components such as an integrated circuit, a resistor and a switch on the PCB so as to transfer signals.

The second antenna unit 120 includes at least one antenna pattern formed on the PCB. Each antenna pattern includes a main antenna pattern and at least one sub antenna pattern according to shapes thereof. Shifted resonant frequencies, the number of the shifted resonant frequencies or a shift amount thereof are determined with respect to the second antenna unit 120 according to the number of antenna patterns and a direction, length or shape of each antenna pattern. The second antenna unit 120 includes at least one antenna pattern formed on the PCB and at least one antenna pattern attached to a structure to which the first antenna unit 110 is attached.

The feeding unit 130 connects the first antenna unit 110 and the second antenna unit 120, and supplies a current to each of the first antenna unit 110 and the second antenna unit 120. For example, the first antenna unit 110 and the second antenna unit 120 are connected to each other through the feeding unit 130, and the feeding unit 130 is formed at a contact point between the first antenna unit 110 and the second antenna unit 120.

The feeding unit 130 may be implemented with a C-clip for connecting the first antenna unit 110 and the second antenna unit 120.

A signal supplied through a signal line formed on the PCB flows along the patterns formed by the first and second antenna patterns 110 and 120 through the feeding unit 130 so as to be emitted at a resonant frequency band of the antenna device 100.

The antenna device 100 may have a resonant frequency band obtained by shifting, by the second antenna unit 120, a resonant frequency of a part of the plurality of resonant frequency bands of the first antenna unit 110.

For example, if it is necessary to shift only a part of a plurality of resonant frequency bands of an existing antenna, some resonant frequencies are shifted easily by adding the second antenna unit 120 without changing a pattern of the existing antenna.

Therefore, it becomes easier to develop an antenna and improve the performance thereof, and antenna devices are easily applied to various electronic devices.

Figures 2A, 2B, 2C:
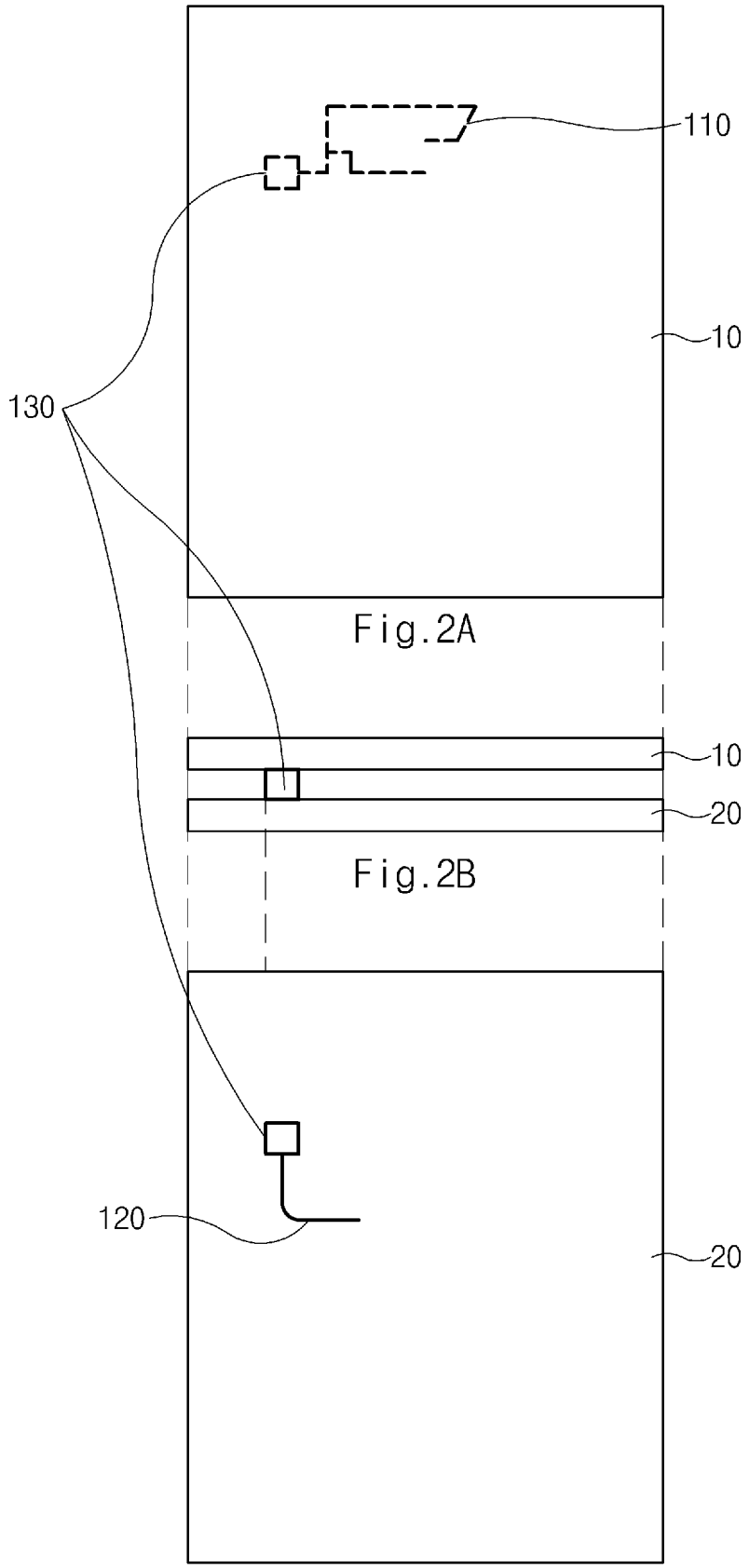
FIGS. 2A to 2C are diagrams illustrating a structure of an antenna device according to an embodiment of the present invention.

FIGS. 2A to 2C are diagrams illustrating a structure of the antenna device according to an embodiment of the present invention.

FIG. 2B is a side view illustrating a connection structure of the first antenna unit 110 and the second antenna unit 120. FIG. 2B illustrates a structure 10 to which the first antenna unit 110 is attached, a PCB 20 on which the second antenna unit is formed, and the feeding unit 130 for connecting the first antenna unit 110 and the second antenna unit 120.

Referring to FIG. 2B, the first antenna unit 110 is attached under the structure 10. The second antenna unit 120 is formed on the PCB 20. The first antenna unit 110 and the second antenna unit 120 are formed on parallel planes respectively while being spaced apart from each other. Furthermore, the first antenna unit 110 and the second antenna unit 120 oppose to each other.

FIG. 2A is a diagram illustrating the first antenna unit 110 and the structure 10 to which the first antenna unit 110 is attached. FIG. 2A is a top view of the structure 10 illustrated in FIG. 2B. The first antenna unit 110 is attached under the structure 10, as illustrated in FIG. 2A. One end of the first antenna unit 110 is connected to the feeding unit 130 that supplies power to the first antenna unit 110.

FIG. 2C is a diagram illustrating the second antenna unit 120 and the PCB 20 on which the second antenna unit 120 is formed. FIG. 2C is a top view of the PCB 20 illustrated in FIG. 2B. The second antenna unit 120 is formed on the PCB 20, as illustrated in FIG. 2C. One end of the second antenna unit 120 is connected to the feeding unit 130 that supplies power to the second antenna unit 120.

For example, the first antenna unit 110 and the second antenna unit 120 is connected to each other through the feeding unit 130, as illustrated in FIGS. 2A-2C. The feeding unit 130 is implemented with a C-clip for connecting the first antenna unit 110 and the second antenna unit 120.

Figure 3:
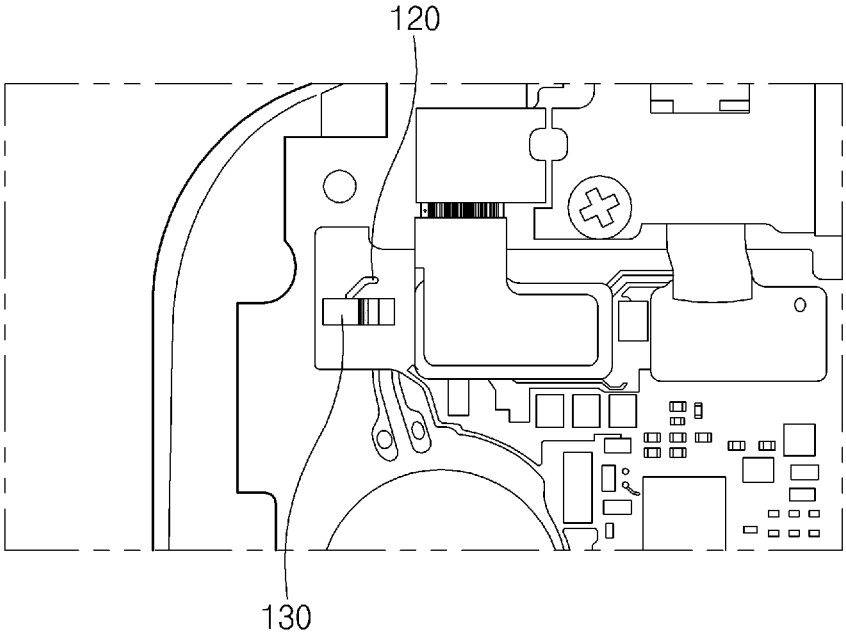
FIG. 3 is a diagram illustrating a structure of a second antenna unit according to an embodiment of the present invention.

FIG. 3 is a diagram illustrating a detailed structure of the second antenna unit according to an embodiment of the present invention. FIG. 3 is a magnified view of a part of the PCB on which the second antenna unit is formed.

Referring to FIG. 3, electronic components, such as an integrated circuit, a resistor and a switch, and microstrip lines that connect the electronic components so as to transfer signals are formed on the PCB. The feeding unit 130 implemented with a C-clip is attached to a partial region of the PCB. The second antenna unit 120 is formed in a preset pattern on a partial region of the PCB. The second antenna unit 120 is connected to the feeding unit 130.

As illustrated in FIG. 3, the second antenna unit 120 is implemented with a microstrip line separate from micro strip lines that connect electronic components such as an integrated circuit, a resistor and a switch on the PCB so as to transfer signals.

When the structure 10 in FIG. 2 to which the first antenna unit is attached is combined with the PCB of FIG. 3, the first antenna unit attached to the structure is connected to the feeding unit 130.

Figure 4:
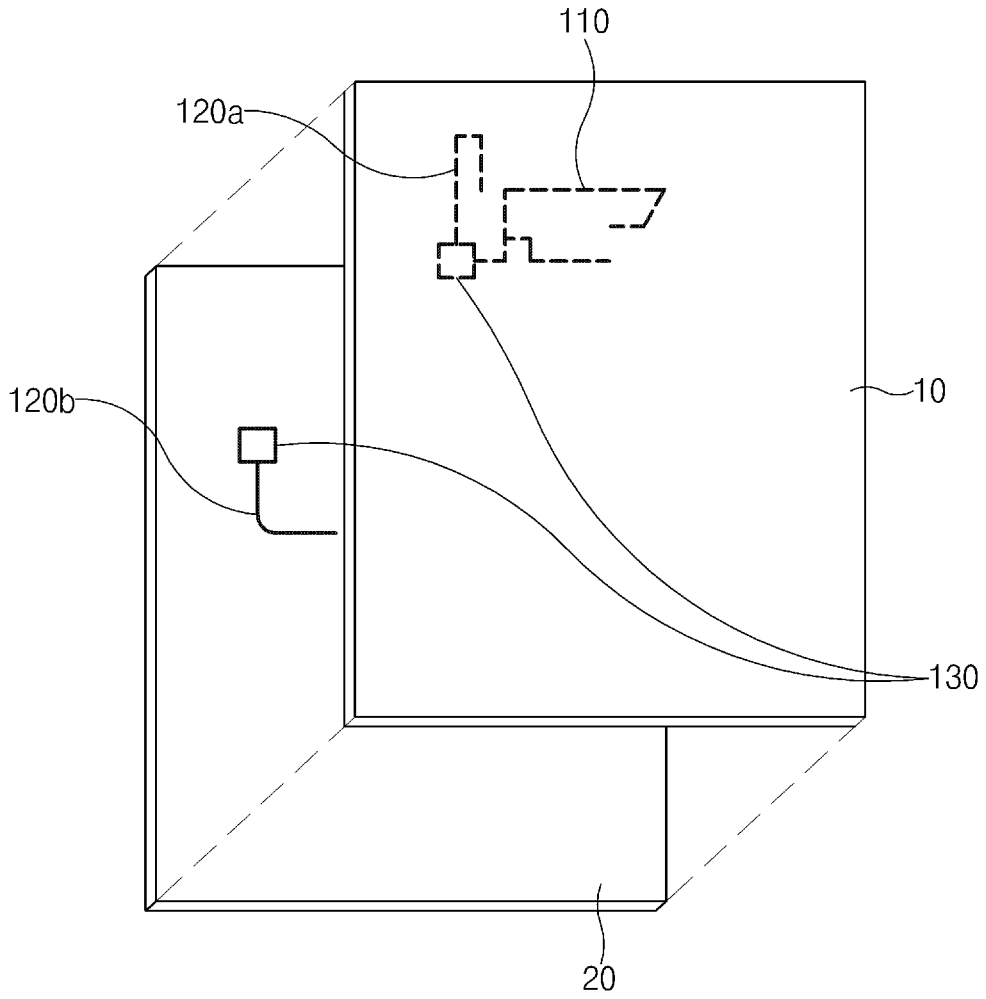
FIG. 4 is a diagram illustrating a structure of an antenna device according to another embodiment of the present invention.

FIG. 4 is a diagram illustrating a structure of the antenna device according to another embodiment of the present invention. FIG. 4 is a side view illustrating a combined structure of a substrate 10 to which the first antenna unit is attached and the PCB on which the second antenna unit is formed.

FIG. 4 illustrates the structure 10 to which the first antenna unit is attached and the PCB 20 on which the second antenna unit is formed. The first antenna unit 110 is attached under the structure 10, as described above with reference to FIG. 2. The second antenna unit includes a first part 120*a* and a second part 120*b*, with the second part 120*b* being formed on the PCB 20 and under the structure 10 to which the first antenna unit 110 is attached. As illustrated in FIG. 4, the second part 120*b* of the second antenna unit is formed on the PCB 20, and the first antenna unit 110 and the first part 120*a* is attached under the structure 10, so that they oppose each other and are formed on planes that are parallel to each other, with the first part 120*a* and the second part 120*b* of the second antenna being spaced apart from each other.

When the structure 10 is combined with the PCB 20, the first antenna unit 110 and the second antenna unit 120 is connected to each other by the feeding unit 130.

Figure 5A:
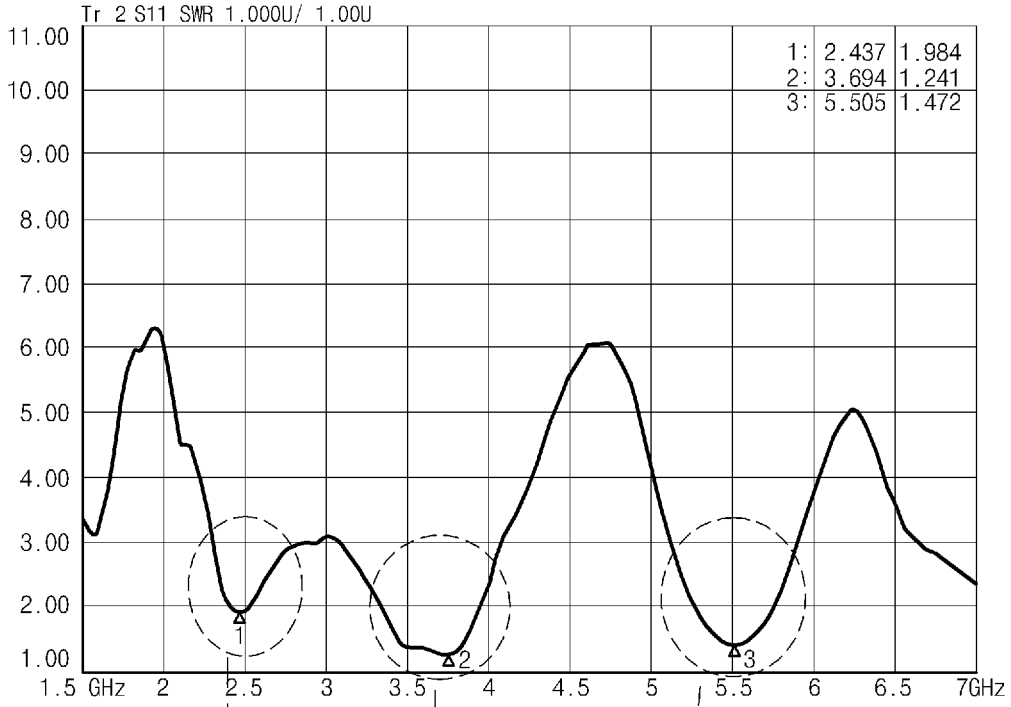
FIGS. 5A and 5B are diagrams illustrating a Voltage Standing Wave Ratio (VSWR) of an antenna device according to an embodiment of the present invention.
Figure 5B:
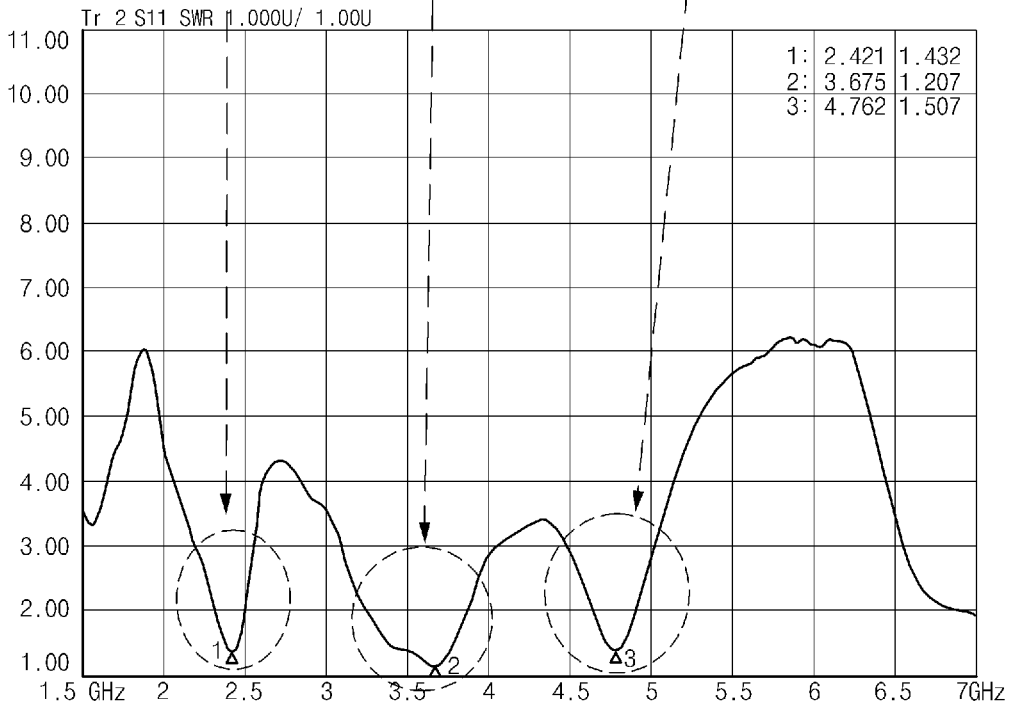

FIGS. 5A and 5B are diagrams illustrating a Voltage Standing Wave Ratio (VSWR) of the antenna device according to an embodiment of the present invention.

FIG. 5A illustrates a VSWR of the first antenna unit 110 excluding the second antenna unit 120. FIG. 5B illustrates a VSWR by the first antenna unit 110 and the second antenna unit 120.

Referring to FIG. 5A, the first antenna unit 110 forms a plurality of different resonant frequency bands. For example, the first antenna unit 110 forms a first resonant frequency band with a resonant frequency of about 2.437 GHz, a second resonant frequency band with a resonant frequency of about 3.694 GHz, and a third resonant frequency band with a resonant frequency of about 5.505 GHz. For example, a VSWR of the first resonant frequency band is about 1.984, a VSWR of the second resonant frequency band is about 1.241, and a VSWR of the third resonant frequency band is about 1.472.

Referring to FIG. 5*b*, the first and second antenna units 110 and 120 forms a plurality of resonant frequency bands. For example, the antennas forms a first resonant frequency band with a resonant frequency of about 2.421 GHz, a second resonant frequency band with a resonant frequency of about 3.675 GHz, and a third resonant frequency band with a resonant frequency of about 4.762 GHz. For example, a VSWR of the first resonant frequency band is about 1.432, a VSWR of the second resonant frequency band is about 1.207, and a VSWR of the third resonant frequency band is about 1.507.

FIGS. 5A and 5B show that the resonant frequencies of the first and second resonant frequency bands are not significantly shifted, but the resonant frequency of the third resonant frequency band is reduced by about 740 MHz.

It may be understood that one of the three resonant frequency bands of the first antenna unit 110 is shifted by the second antenna unit 120. Furthermore, it may be understood that the second antenna unit 120 hardly affects the other resonant frequency band of the first antenna unit 110.

Figure 6A:
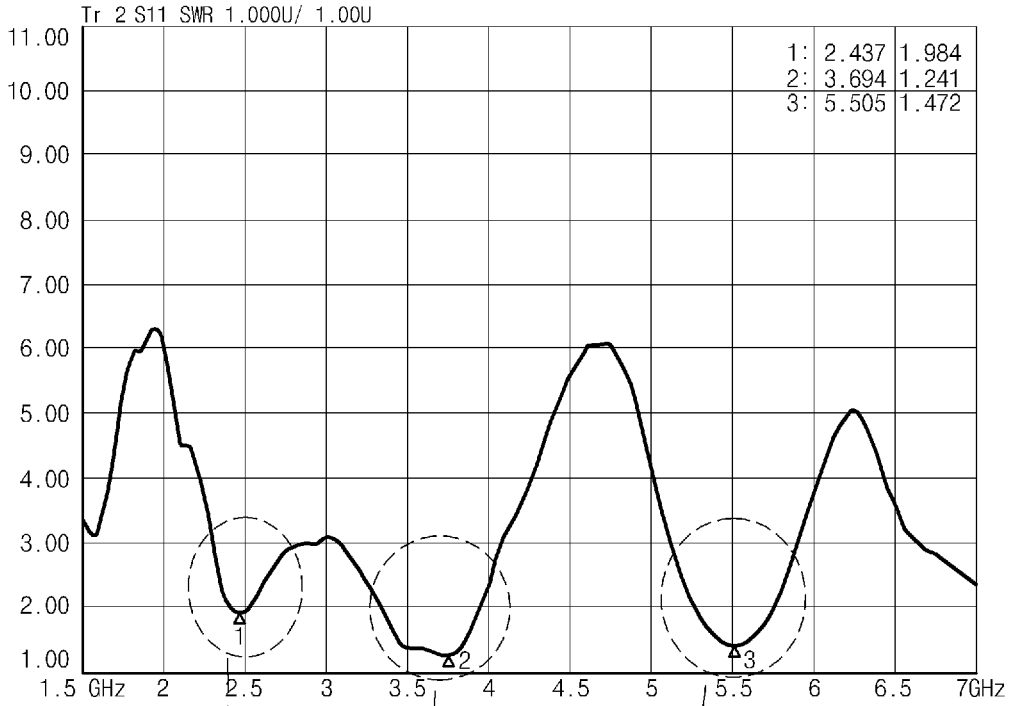
FIGS. 6A and 6B are diagrams illustrating a VSWR of an antenna device according to another embodiment of the present invention.
Figure 6B:
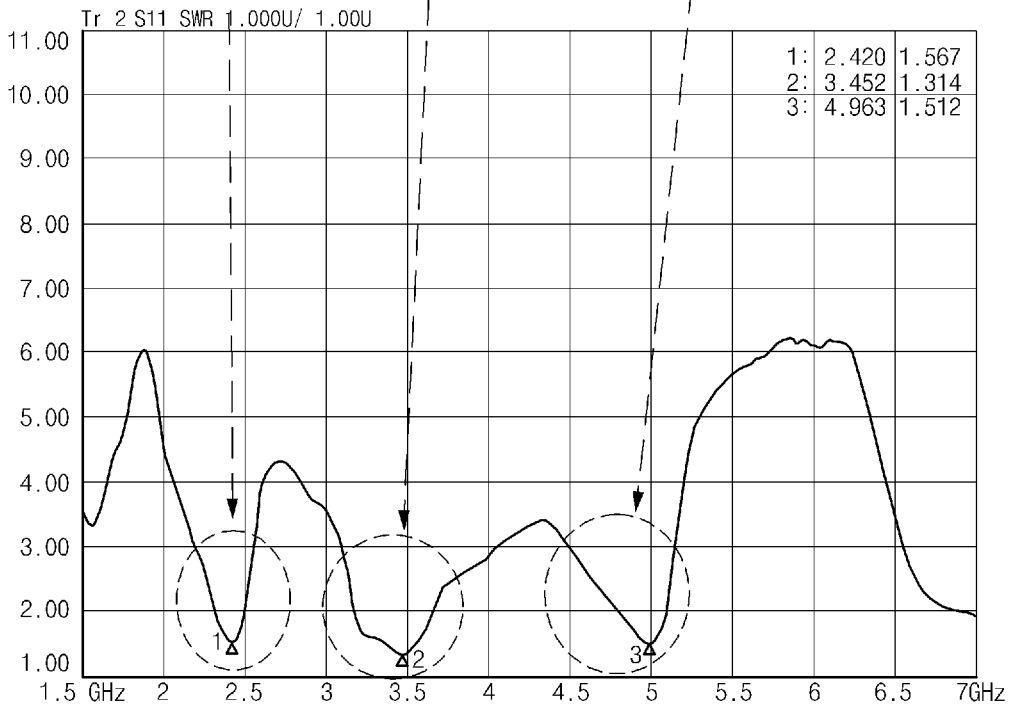

FIGS. 6A and 6B are diagrams illustrating a VSWR of the antenna device according to another embodiment of the present invention.

FIG. 6A illustrates a VSWR of the first antenna unit 110 excluding the second antenna unit 120. FIG. 6B illustrates a VSWR by the first antenna unit 110 and the second antenna unit 120.

Referring to FIG. 6A, the first antenna unit 110 forms a plurality of different resonant frequency bands. For example, the first antenna unit 110 forms a first resonant frequency band with a resonant frequency of about 2.437 GHz, a second resonant frequency band with a resonant frequency of about 3.694 GHz, and a third resonant frequency band with a resonant frequency of about 5.505 GHz. For example, a VSWR of the first resonant frequency band is about 1.984, a VSWR of the second resonant frequency band is about 1.241, and a VSWR of the third resonant frequency band is about 1.472.

Referring to FIG. 6B, the first and second antenna units 110 and 120 forms a plurality of resonant frequency bands. For example, the antennas form a first resonant frequency band with a resonant frequency of about 2.420 GHz, a second resonant frequency band with a resonant frequency of about 3.452 GHz, and a third resonant frequency band with a resonant frequency of about 4.963 GHz. For example, a VSWR of the first resonant frequency band is about 1.567, a VSWR of the second resonant frequency band is about 1.314, and a VSWR of the third resonant frequency band is about 1.512.

FIGS. 6A and 6B show that the resonant frequency of the first resonant frequency band is not significantly shifted, but the resonant frequencies of the second and third resonant frequency bands are reduced by about 250 MHz and about 540 MHz, respectively.

It may be understood that two of the three resonant frequency bands of the first antenna unit 110 are shifted by the second antenna unit 120. Furthermore, it may be understood that the second antenna unit 120 hardly affects the other resonant frequency band of the first antenna unit 110.

The antenna device 100 may include the first antenna unit having a plurality of resonant frequency bands, a second antenna unit that shifts a resonant frequency of a part of the plurality of resonant frequency bands of the first antenna unit, and the feeding unit that connects the first and second antenna units and supplies current thereto.

Figure 7:
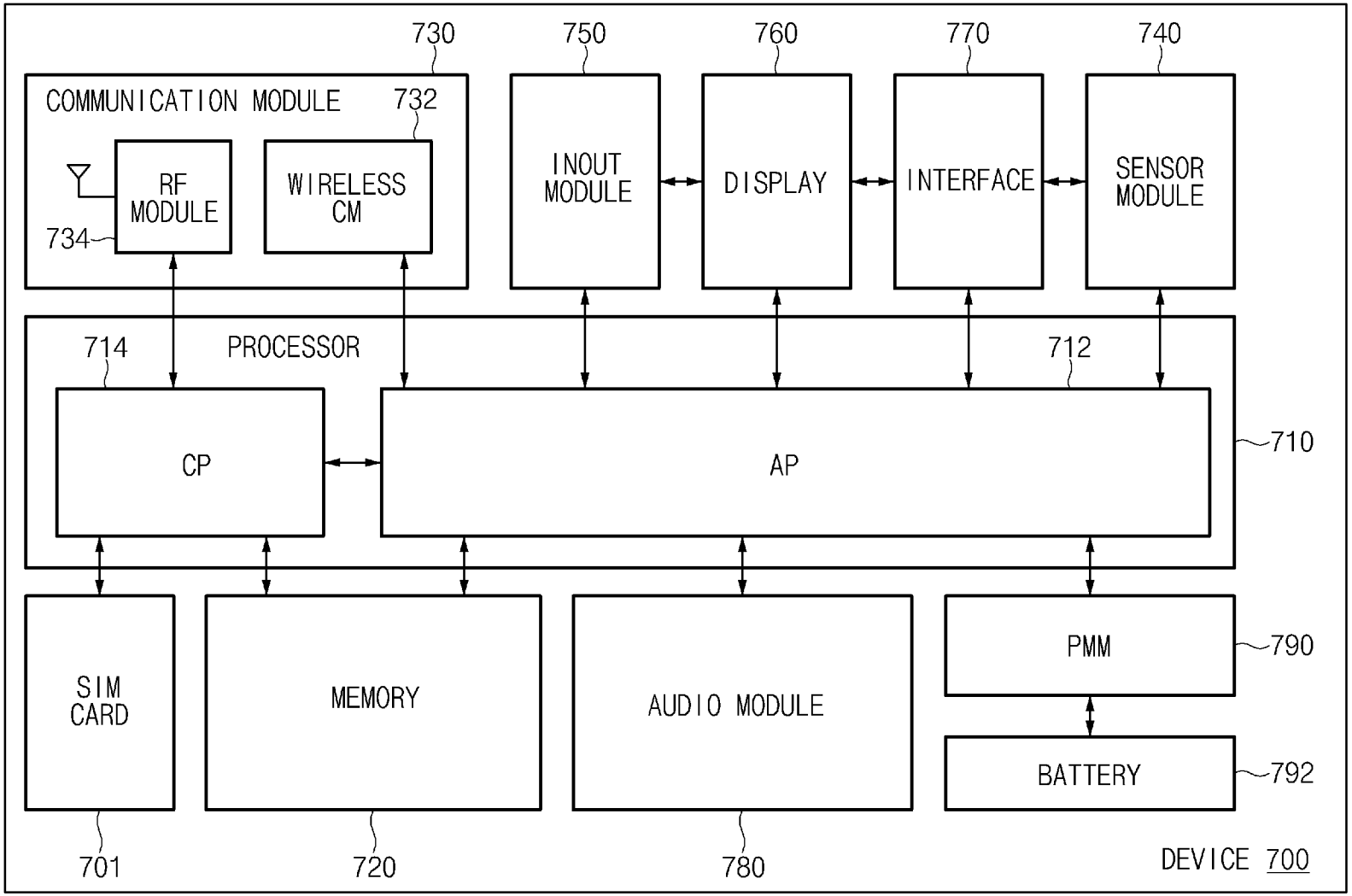
FIG. 7 is a diagram illustrating a structure of an electronic device including an antenna device according to an embodiment of the present invention.

FIG. 7 is a diagram illustrating a structure of an electronic device including the antenna device according to an embodiment of the present invention.

Referring to FIG. 7, an electronic device 700 includes a processor 710, a communication module 730, a sensor module 740, an input module 750, a display 760, an interface 770, an audio module 780, a Power Management Module (PMM) 790, a battery 792, and a SIM card 701. The electronic device 700 may be implemented with various devices capable of performing wireless communication, such as a cell phone, a tablet PC, a navigator, and a smart TV.

The processor 710 includes an Application Processor (AP) 712 and a Communication Processor (CP) 714. Although FIG. 7 illustrates that the AP 712 and the CP 714 are included in the processor 710, the AP 712 and the CP 714 may be included in different IC packages. The AP 712 and the CP 714 may also be included in a single IC package.

The AP 712 runs an operating system or an application program so as to control a plurality of hardware components connected to the AP 712 or software components, and performs an operation and processes various types of data including multimedia data. The AP 712 may be implemented with, for example, a System on Chip (SoC). The processor 710 may further include a Graphic Processing Unit (GPU).

The CP 714 manages a data link and converts a communication protocol for communication between the electronic device 700 and other electronic devices connected thereto through a network. The CP 714 may be implemented with an SoC. The CP 714 performs at least a part of a multimedia control function. The CP 714 identifies and authenticates electronic devices in a communication network using, for example, a Subscriber Identification Module (e.g., the SIM card 701). Furthermore, the CP 714 provides services such as voice call, video call, and text message or packet data transmission to users.

The CP 714 controls data transmission/reception of the communication module 730. Although FIG. 15 illustrates that the CP 714, the power management module 790, and the memory 720 are separate from the AP 712, the AP 712 may include at least one of the foregoing elements (e.g., the CP 714).

The AP 712 or CP 714 loads, on a volatile memory, a command or data received from a nonvolatile memory connected to the AP 712 or CP 714 or at least one of the other elements so as to process the command or data. Furthermore, the AP 712 or CP 714 stores, in the nonvolatile memory, data received from or generated by at least one of the other elements.

The SIM card 701 includes a subscriber identification module, and is inserted into a slot formed at a specific location of the electronic device. The SIM card 701 includes unique identification information (e.g., an Integrated Circuit Card Identifier (ICCID)) or subscriber information (e.g., International Mobile Subscriber Identity (IMSI)).

The memory 720 includes an internal memory and/or an external memory. The internal memory may include at least one of volatile memories such as a Dynamic Random-Access Memory (DRAM), a Static Random-Access Memory (SRAM) and a Synchronous Dynamic Random-Access Memory (SDRAM) or nonvolatile memories such as a One Time Programmable Read-Only Memory (ROM) (OTPROM), a Programmable ROM (PROM), an Erasable Programmable ROM (EPROM), an Electrically Erasable Programmable ROM (EEPROM), a mask ROM, a flash ROM, a NAND flash memory and a NOR flash memory. The internal memory may be a Solid-State Drive (SSD). The external memory may further include a flash drive such as a Compact Flash (CF) card, a Secure Digital (SD) card, a micro-SD card, a mini-SD card, an xD (extreme digital) picture card or a memory stick. The external memory may be functionally connected to the electronic device 700 through various interfaces. The electronic device 700 may further include a storage device (or a storage medium) such as a Hard Disk Drive (HDD).

The communication module 730 includes a wireless communication module 732 and/or a Radio Frequency (RF) module 734. The wireless communication module 732 may include, for example, a Wi-Fi module, a Bluetooth module, a Global Positioning System (GPS) module or a Near Field Communication (NFC) module. The wireless communication module 732 provides a wireless communication function using a radio frequency. The wireless communication module 732 includes a network interface (e.g., a Local Area Network (LAN) card) or modem for connecting the electronic device 700 to a network (e.g., Internet, LAN, Wide Area Network (WAN), telecommunication network, cellular network, satellite network or Plain Old Telephone Service (POTS)).

The RF module 734 performs data communication such as transmission/reception of RF signals. The RF module 734 may include, for example, a transceiver, a Power Amp Module (PAM), a frequency filter or a Low Noise Amplifier (LNA).

The communication module 730 includes an antenna for transmitting/receiving free-space electromagnetic waves in a wireless communication system. A plurality of antennas for the wireless communication module 732 and/or the RF module 734 may be included. The communication module 730 includes at least one antenna shared by the wireless communication module 732 and the RF module 734. The antenna device 100 corresponds to an antenna included in the communication module 730 so as to transmit/receive various signals. When the antenna device 100 is included in the communication module 730, the antenna device 100 receives signals transmitted from external devices to transfer the signals to the wireless communication module 732 and/or the RF module 734, and emits signals received from the wireless communication module 732 and/or the RF module 734 to the outside.

The sensor module 740 measures physical quantity or detects an operation state of the electronic device 700 so as to convert measured or detected information into an electric signal. The sensor module 740 includes at least one of a gesture sensor, a gyro sensor, a barometer sensor, an accelerometer sensor, a grip sensor, a proximity sensor, a color sensor (e.g., RGB sensor), a biometric sensor, a temperature/humidity sensor, an illuminance, and an ultraviolet (UV) sensor. Furthermore, the sensor module 740 may include an olfactory sensor, an electromyography (EMG) sensor, an electroencephalogram (EEG) sensor, an electrocardiogram (ECG) sensor, an IR sensor, an iris recognition sensor, or a fingerprint sensor. The sensor module 740 may further include a control circuit for controlling at least one sensor.

The input module 750 includes a touch panel, a (digital) pen sensor, and a key or ultrasonic input device. The touch panel recognizes a touch input using at least one of capacitive, resistive, infrared and ultraviolet sensing methods. The touch panel may also include a control circuit. When using the capacitive sensing method, a physical contact recognition or proximity recognition is allowed. The touch panel may further include a tactile layer. In this case, the touch panel provides tactile reaction to a user.

The display 760 includes a panel, a hologram or a projector. For example, the panel may be a Liquid Crystal Display (LCD) or an Active Matrix Organic Light Emitting Diode (AM-OLED). The panel may be flexible, transparent or wearable. The panel and the touch panel may be integrated into a single module. The hologram displays an image in a space using a light interference phenomenon. The projector projects light onto a screen so as to display an image. The screen is arranged in the inside or the outside of the electronic device 700. The display 760 may include a control circuit for controlling the panel, the hologram, or the projector.

The interface 770 includes a High Definition Multimedia Interface (HDMI), a Universal Serial Bus (USB) and an optical communication port or a D-sub port. The interface 770 includes a Mobile High-definition Link (MHL), an SD card/Multi-Media Card (MMC), or Infrared Data Association (IrDA).

The audio module 780 converts a sound into an electric signal or vice versa. The audio module 780 processes sound information input or outputs through a speaker, a receiver, an earphone or a microphone.

The power management module 790 manages power of the electronic device 700. The power management module 790 includes a Power Management Integrated Circuit (PMIC), a charger Integrated Circuit (IC), or a battery or fuel gauge.

Portable electronic devices such as smartphones and tablet PCs are limited in spaces for antennas, which makes it difficult to design antennas having specific frequency bands. Furthermore, interference from other components may degrade the performance of an antenna. Antenna performance of such a portable device is improved by applying the antenna device 100 according to an embodiment of the present invention.

A resonant frequency shifting method for the antenna device according to an embodiment of the present invention includes a process in which a resonant frequency of a part of a plurality of resonant frequency bands of a first antenna unit are shifted by a second antenna unit that is formed on a plane parallel with the first antenna unit while being spaced apart from the second antenna unit.

The second antenna unit may be formed on a PCB. For example, the second antenna unit may be a microstrip line formed on the PCB. The second antenna unit may be a microstrip line different from other microstrip lines formed on the PCB so as to transmit signals. A resonant frequency band of which a resonant frequency is shifted and a frequency shift amount may be determined by at least one of the number, positions, directions, sizes and shapes of the second antenna unit.

According to the above-described various embodiments of the present invention, a resonant frequency of a part of a plurality of resonant frequency band of an antenna device may be shifted. Therefore, the performance of the antenna device (e.g., a multiband antenna) may be improved, and the antenna device may be applied to various electronic devices. For example, when the antenna device is applied to electronic devices with different antenna structures and some resonant frequency bands are shifted due to effects from other elements included in the electronic device, the resonant frequency bands are shifted back to original positions according to the various embodiments of the present invention.

While the present invention has been particularly shown and described with reference to certain embodiments thereof, various changes in form and detail may be made therein without departing from the spirit and scope of the present invention as defined by the following claims. Accordingly, the scope of the present invention will be defined by the appended claims and equivalents thereto.

What is claimed is:

1. An electronic device for transmitting/receiving signals, the electronic device comprising:

a first antenna unit;

a second antenna unit configured to shift a resonant frequency of a part of the plurality of resonant frequency bands of the first antenna unit;

a feeding unit configured to connect the first antenna unit and the second antenna unit and to supply current thereto;

a printed circuit board (PCB); and a structure, wherein the second antenna unit shifts a resonant frequency of one of the plurality of resonant frequency bands of the first antenna unit, without substantial shifting of resonant frequencies of other resonant frequency bands, wherein the resonant frequency band of which the resonant frequency is shifted is determined by at least one of a number and a direction of the second antenna unit, wherein the first antenna unit is attached under the structure, wherein a part of the second antenna unit is formed on the PCB that is under and spaced apart from the first antenna unit, wherein the first antenna unit and the second antenna unit are formed on planes parallel with each other, and wherein the feeding unit comprises a C-clip connecting the first antenna unit and the second antenna unit, and the C-clip is attached to a partial region of the PCB.

2. The electronic device of claim 1, wherein the second antenna unit is formed on the PCB.

3. The electronic device of claim 1, wherein the second antenna unit is a microstrip line formed on the PCB.

4. The electronic device of claim 3, wherein the second antenna unit microstrip line is different from another microstrip line formed on the PCB to transmit a signal.

5. The electronic device of claim 1, wherein a frequency shift amount is determined by at least one of the number, positions, directions, sizes and shapes of the second antenna unit.

6. The electronic device of claim 1, wherein the first antenna unit and the second antenna unit are spaced apart from each other.

* * * * *